US005711749A

United States Patent [19]

Miller

[11] Patent Number: 5,711,749

[45] Date of Patent: Jan. 27, 1998

[54] TRUNK STRENGTHENING CARDIOVASCULAR EXERCISE APPARATUS

[75] Inventor: Kenneth Miller, New York, N.Y.

[73] Assignee: Aerobic Funding One, LLC, New York, N.Y.

[21] Appl. No.: 539,984

[22] Filed: Oct. 6, 1995

[51] Int. Cl.[6] ..... A63B 21/00; A63B 23/02

[52] U.S. Cl. ..... 482/135; 482/92; 482/95; 482/111; 482/139; 482/142; 482/903

[58] Field of Search ..... 482/92, 98, 99–103, 482/111, 133–143, 145, 148

[56] References Cited

U.S. PATENT DOCUMENTS

| | | | |
|---|---|---|---|
| 3,043,591 | 7/1962 | Sellner | 482/142 |
| 3,589,720 | 6/1971 | Agamian | 482/135 |
| 4,183,520 | 1/1980 | Chase . | |
| 4,387,893 | 6/1983 | Baldwin | 482/137 |
| 4,462,252 | 7/1984 | Smidt et al. . | |
| 4,627,619 | 12/1986 | Rockwell et al. . | |
| 4,725,054 | 2/1988 | Solow et al. . | |
| 4,872,669 | 10/1989 | Henry . | |
| 4,915,378 | 4/1990 | Abrahamian et al. | 482/137 |
| 4,984,986 | 1/1991 | Vohnout | 482/73 |
| 5,094,446 | 3/1992 | Wiedner | 482/73 |
| 5,178,599 | 1/1993 | Scott . | |
| 5,256,126 | 10/1993 | Grotstein . | |
| 5,336,149 | 8/1994 | Wang | 482/137 |
| 5,352,171 | 10/1994 | Lin . | |

FOREIGN PATENT DOCUMENTS

| | | | |
|---|---|---|---|
| 2581550 | 11/1986 | France | 482/137 |

*Primary Examiner*—Lynne A. Reichard
*Assistant Examiner*—Victor K. Hwang
*Attorney, Agent, or Firm*—Pennie & Edmonds LLP

[57] ABSTRACT

Apparatus for exercising a user's abdominal muscles and/or back muscles. This exercise apparatus includes a dynamic means in the form of an upper frame which is pivotally attached to a lower form. With the use of the user's abdominal and/or back muscles, the dynamic means produces a forward folding movement and a return straightening movement. A framework means in the form of a vertical frame affixed to a horizontal frame which maintains the vertical frame in an upright position supports the dynamic means. This exercise apparatus also includes a resistance means for opposing the forward folding movement and/or the return straightening movement. Various resistant means include fly wheel-fan, electro-magnetic and weight stack.

28 Claims, 12 Drawing Sheets

TRUNK STRENGTHENING CARDIOVASCULAR EXERCISE APPARATUS

BACKGROUND

The present invention relates generally to an exercise apparatus and more particularly an exercise apparatus for strengthening the trunk muscles, specifically the abdominal and back muscles, while providing for cardiovascular exercise through total body movement.

Large numbers of people suffer from back pain. In addition to increasing overall physical fitness, strengthening the abdominal and back muscles helps to alleviate back pain. There is also a need for an apparatus that provides a cardiovascular or aerobic exercise while strengthening the abdominal and back muscles, particularly the lower back muscles.

There are a number of prior art devices that are directed toward strengthening the muscles of the torso. For example, U.S. Pat. No. 5,178,599 to Scott discloses a bidirectional, total body exercise machine. The Scott machine provides a stationary handle bar, which the user grasps, and a lever, which allows pivoting motion, with foot pedals attached to one end and a seat mounted on the other end.

U.S. Pat. No. 4,627,619 to Rockwell et al. and U.S. Pat. No. 5,256,126 to Grotstein both disclose abdominal and back exercising devices, which provide a pivotable member against which a user's torso pushes during exercise. The user sits in one position on the stationary seat when exercising the abdominal muscles and in another position when exercising the back muscles. In both positions, the feet are held in a stationary position. With both of these devices, the pivotable member will compress the spine during exercise if the exerciser does not position himself correctly on the stationary seat or if he slouches while exercising.

None of the devices discussed above provides for the particular combination of strengthening the trunk muscles in combination with cardiovascular exercise. Thus, there is a need for such an apparatus.

It would be desirable to simulate the abdomen strengthening features of the popular floor exercise commonly known as "crunches" in which a "crunch" position alternates with a release position. Initially, the exerciser assumes the release position, lying on his back on the floor with his hands behind his head, his legs bent at the knees and his feet lifted slightly off the floor. To achieve the "crunch" position, the exerciser uses his abdominal muscles to pull his shoulders and knees toward each other. Then to achieve the release position, the exerciser relaxes his abdominal muscles, allowing his shoulders and knees to move away from each other. There are also variations of this exercise. For example, one can prop one's legs up with an object such as a chair and perform this exercise while keeping the legs immobilized. In addition, one can cross one's arms across one's chest instead of putting them behind one's head. This exercise serves to strengthen the abdominal muscles. However, it does not exercise the back muscles to the same extent, nor does it provide for a cardiovascular workout. In addition, with each of this exercise's variations, there is always the risk of harmfully straining the exerciser's neck.

SUMMARY OF INVENTION

It is therefore an object of the present invention to provide an apparatus that provides for strengthening the trunk muscles in combination with a cardiovascular workout.

A further object of the present invention is to provide an apparatus that provides for strengthening of the trunk muscles without straining the exerciser's neck or compressing the exerciser's spine.

A further object of the present invention is to provide an apparatus that will exercise the body without causing undue stress or injury to the body. For example, the present invention does not bend the knees excessively; therefore, undue stress on the knees is avoided. Also the present invention tends to maintain the proper posture of a user without imposing stress or pressure on the back.

A further object of the present invention is to provide an apparatus that has an adjustable resistance capability so that users of varying degrees of fitness and physical strength may benefit from the use of the present invention.

A further object of the present invention is to simulate the abdomen strengthening features of the "crunches" exercise in the vertical position while adding a dynamic movement, which provides a cardiovascular workout.

These and other objects are achieved according to the present invention by an apparatus for trunk strengthening and cardiovascular exercise. Briefly summarized, this apparatus has three major elements: a dynamic means for producing two movements, termed a forward folding movement and a return straightening movement, which require the use of a user's trunk muscles; a framework means for supporting the dynamic means; and a resistance means for opposing the forward folding movement and/or the return straightening movement.

The dynamic means comprises an upper frame which is pivotally attached to a lower frame. The dynamic means further comprises means to adapt the apparatus to the human body, such as arm rests, a seat and a foot rest. The arm rests and foot rests may be adjustable to suit the height and size of the user.

During exercise, the user uses his abdominal muscles to pull the arm rests toward the foot rest, thereby rocking the seat backward. Then the user uses his back muscles to push the arms rests away from the foot rest, thereby rocking the seat forward. The apparatus provides resistance for both motions and stops as soon as the user does. There are various resistance means which are known in the art which are easily adaptable to the present invention.

In an alternative embodiment, the apparatus may be configured such that resistance is provided against only one of the two movements, and the apparatus effects the other movement on its own without requiring exertion of the user's muscles.

In another alternative embodiment, the apparatus may be configured such that the forward folding movement is effected by pulling the legs up instead of pushing the arms down.

BRIEF DESCRIPTION OF THE DRAWINGS

Reference is next made to a brief description of the drawings, which are intended to illustrate a first embodiment and a number of alternative embodiments of the exercise apparatus according to the present invention. The drawings and detailed description which follow are intended to be merely illustrative, and are not intended to limit the scope of the invention as set forth in the appended claims.

DETAILED DESCRIPTION

Figure 1:
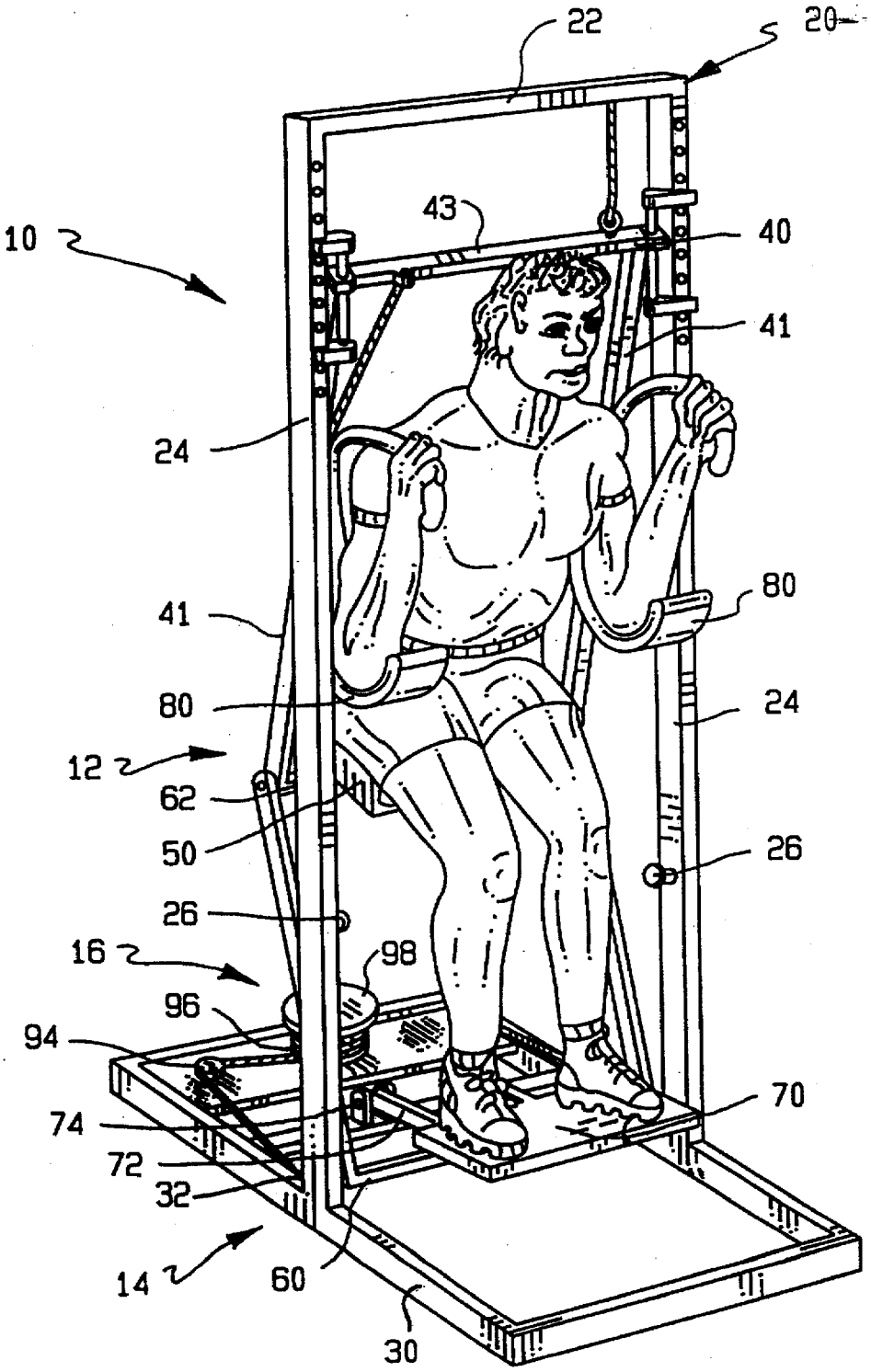
FIG. 1 is a front perspective view of a person using a first embodiment of the trunk strengthening, cardiovascular exercise apparatus according to the present invention.
Figure 2:
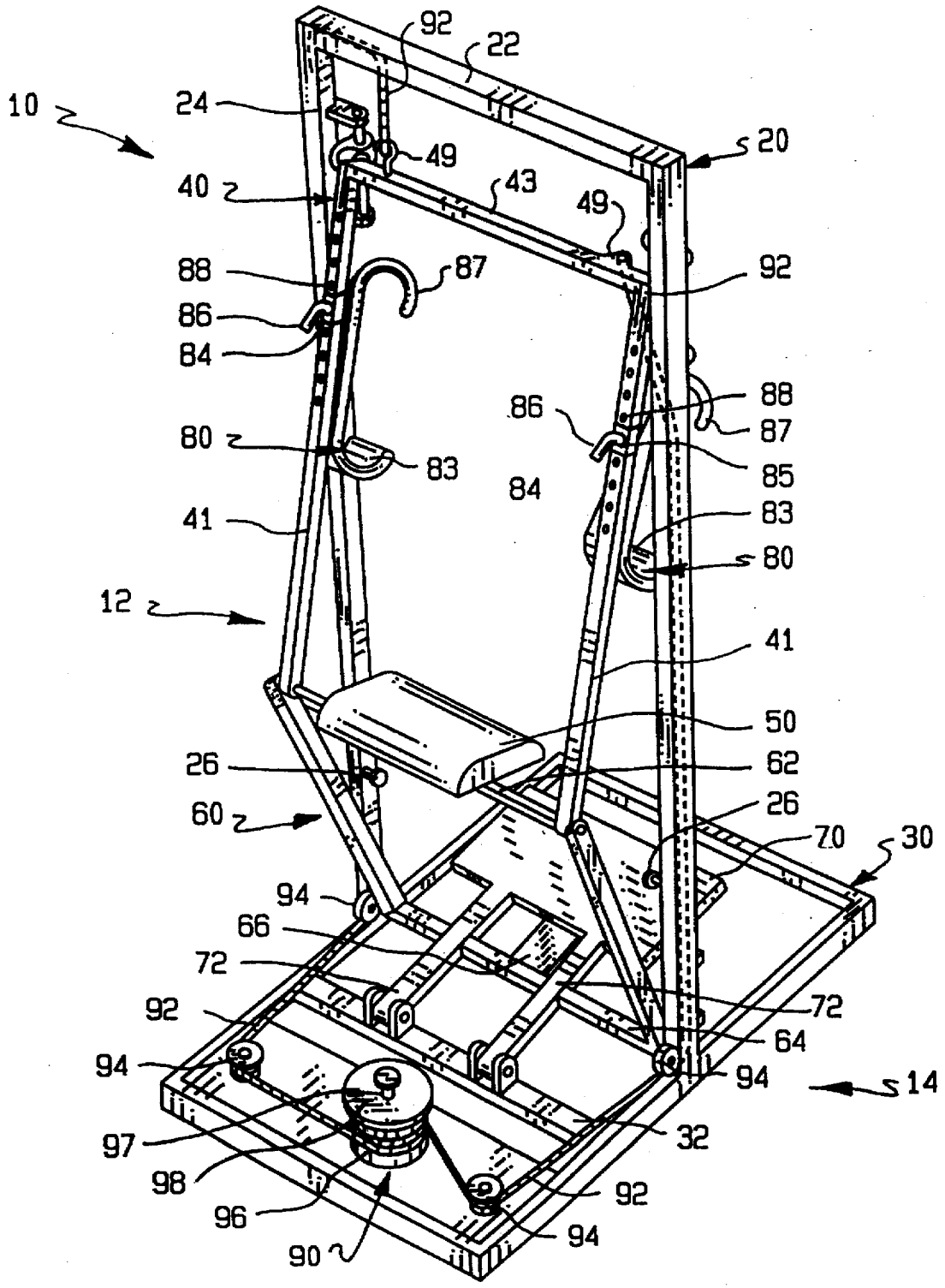
FIG. 2 is a back perspective view of the apparatus shown in FIG. 1.

Referring more particularly to the drawings, FIGS. 1 and 2 show the first embodiment of the exercise apparatus 10 according to the present invention. The exercise apparatus 10 comprises a dynamic means 12, a framework means 14 and a resistance means 16. The dynamic means 12 comprises an upper frame 40 which is pivotally attached to a lower frame 60. The dynamic means 12 further comprises arm rests 80 which are attached to lateral members 41 of the upper frame 40, a seat 50 which is pivotally mounted to a top frame member 62 of the lower frame 60, and a foot rest 70.

The framework means 14 comprises a vertical frame 20 which is maintained in an upright position by a horizontal frame 30. Horizontal frame 30 is configured to lie on a flat surface. However, there are other ways known in the art to stabilize the dynamic means 12 such as bolting the vertical frame 20 to the ceiling.

Figure 3:
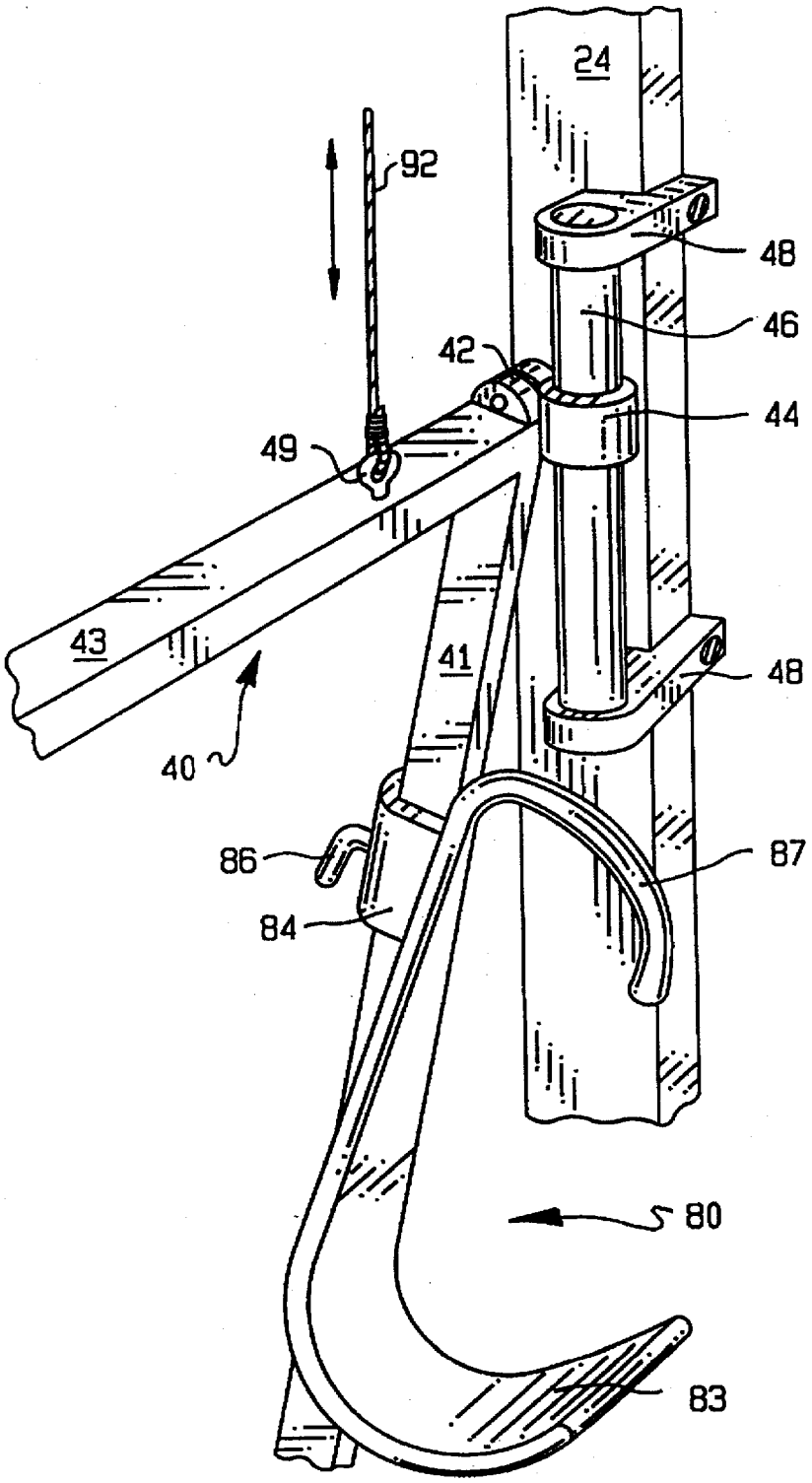
FIG. 3 is a partial, enlarged perspective view of the attachment of the upper frame to the vertical frame of the apparatus shown in FIGS. 1 and 2.

Both the upper frame 40 and the lower frame 60 are pivotally mounted to the vertical frame 20. Additionally, the upper frame 40 is slideably mounted to the vertical frame 20. As shown in FIG. 3, pivotal attachments 42 on the upper frame 40 are mounted on linear bearings 44 which slide along rods 46 secured to flanges 48 which in turn are secured to the lateral members 24 of the vertical frame 20.

As shown in more detail in FIG. 2, arms 72 of the foot rest 70 are pivotally attached to a cross frame member 32 of the horizontal frame 30 in a manner well known in the art. The components of the present invention are constructed of commercially available materials, the selection of which is within the ability of the ordinary skilled worker.

As shown in FIGS. 2 and 3, the arm rests 80 have hand grips 87 attached to elbow rests 83 which in turn are attached to sleeves 84 that fit around and slide along the lateral members 41 of the upper frame 40, enabling the arm rests 80 to be adjusted to the heights of different users. The arms rests 80 also have adjustment pins 86 which fit through holes 85 of the sleeves 84 and two of a plurality of adjustment holes 88 on the lateral members 41 of the upper frame 40, thereby securing the arm rests 80 to the upper frame 40. Alternatively, the arm rests may be configured such that the arm rests are connected to each other so that the user need make only one adjustment.

Figure 4:
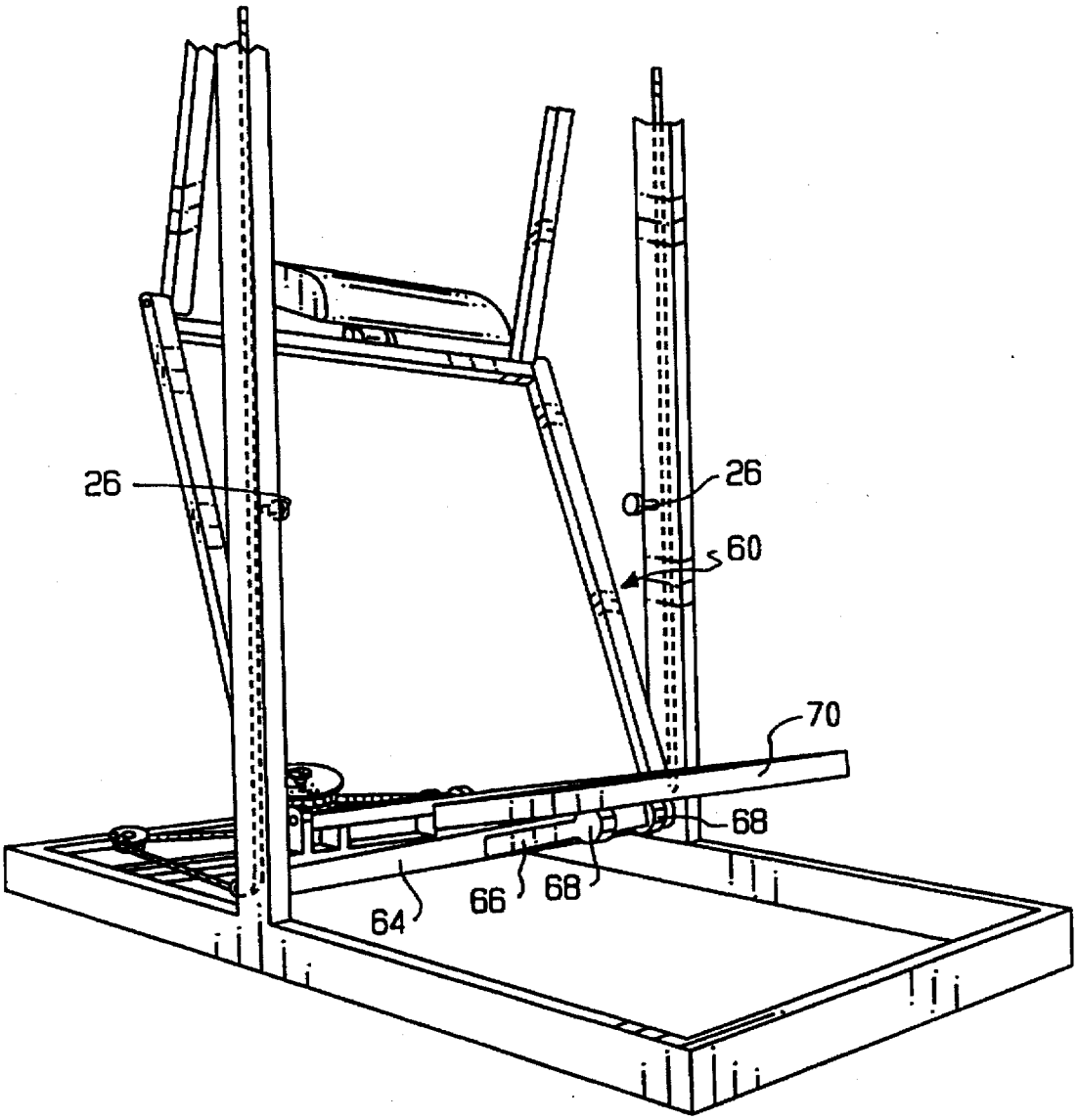
FIG. 4 is a partial, enlarged perspective view of the lower frame and the foot rest of the apparatus shown in FIGS. 1 and 2.

As shown in FIGS. 2 and 4, the lower frame 60 has a projecting member 66 attached to a bottom frame member 64 of the lower frame 60 such that the projecting member 66 remains at a fixed angle with respect to the plane defined by the lower frame 60. Rollers 68 attached to the end of the projecting member 66 contact the foot rest 70 such that the pivoting motion of the lower frame 60 with respect to the vertical frame 20 effects a concurrent pivoting motion in the foot rest 70 about the cross frame member 32.

In the embodiment shown in FIG. 1, resistance to both the forward folding movement and the return straightening movement is provided by a fly wheel-fan resistance mechanism 90 which is known in the art. As seen in more detail in FIG. 2, cables 92 are attached to the pair of cable connections 49 attached to each side of the top member 43 of the upper frame 40. One of the cables 92 runs up to the top member 22 of the vertical frame 20, within the top member 22 of the vertical frame 20, then down within the lateral member 24 of the vertical frame 20 to the base of the vertical frame 20. The other one of the cables 92 runs to the lateral member 24 of the vertical frame 20 to the base of the vertical frame 20. The cables 92 are guided by a system of pulleys 94 to the fly wheel-fan resistance mechanism 90 having a drum 96, a shaft 97 and a fly wheel-fan 98. The cables 92 are wrapped around the drum 96 so that movement of the upper frame 40 causes the cables 92 to rotate the drum 96. The drum 96 is ratchet mounted on and drives the shaft 97, which in turn drives resistance means such as the fly wheel-fan 98.

In order to use this apparatus, the user first stands on the foot rest 70, leans back against the seat 50 and places his arms in the arm rests 80. As described above, a user may adjust the arm rests 80 along the lateral members 41 of the upper frame 40 to suit his particular height. In addition, the hand grips 87 of the arm rests 80 are curved such that any user may grip the hand grips 87 while resting his elbows in the elbow rests 83 regardless of the length of his forearms.

Figure 5:
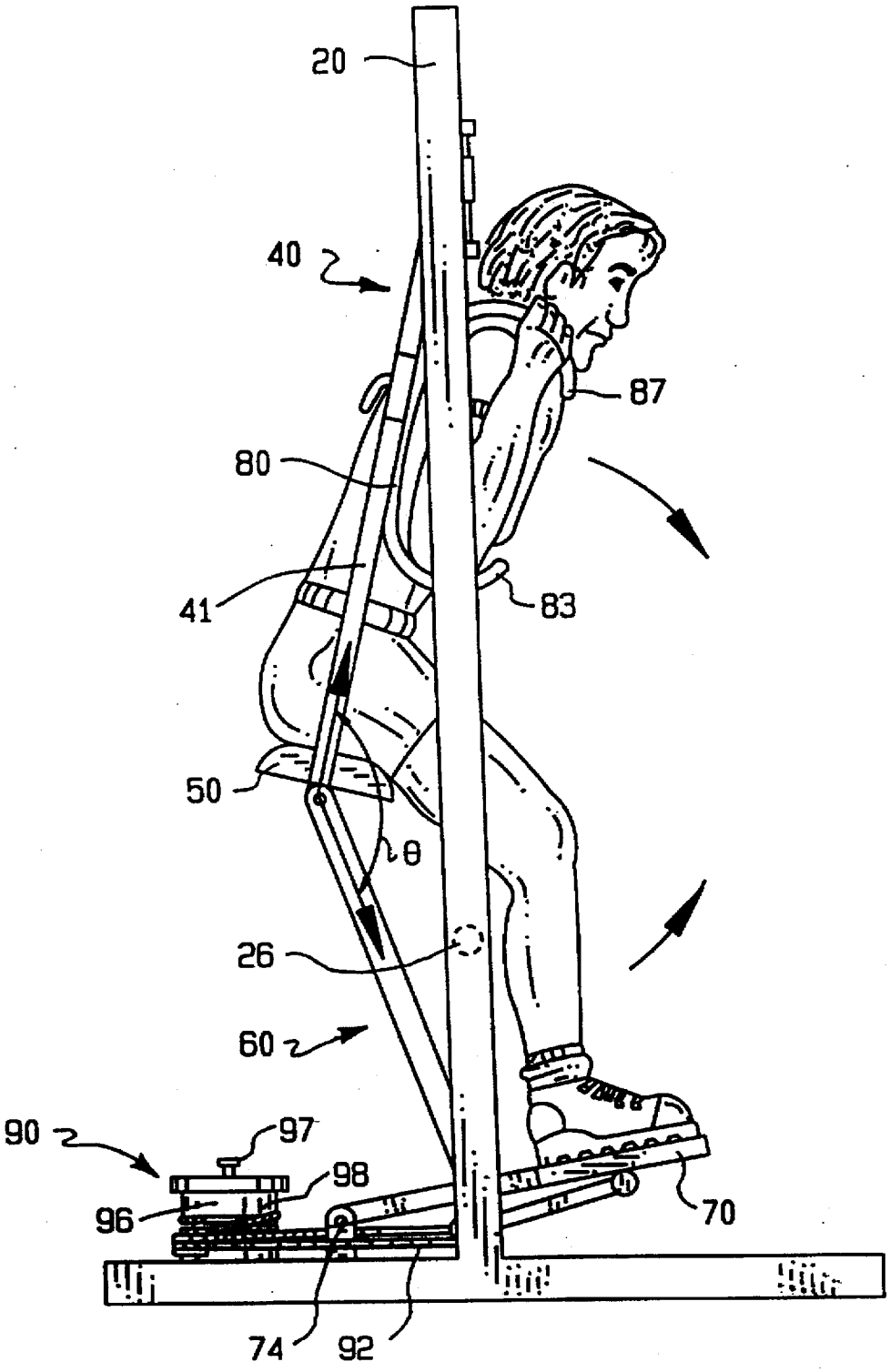
FIG. 5 is a side view of a user in a forward folding movement on the apparatus according to the present invention.
Figure 6:
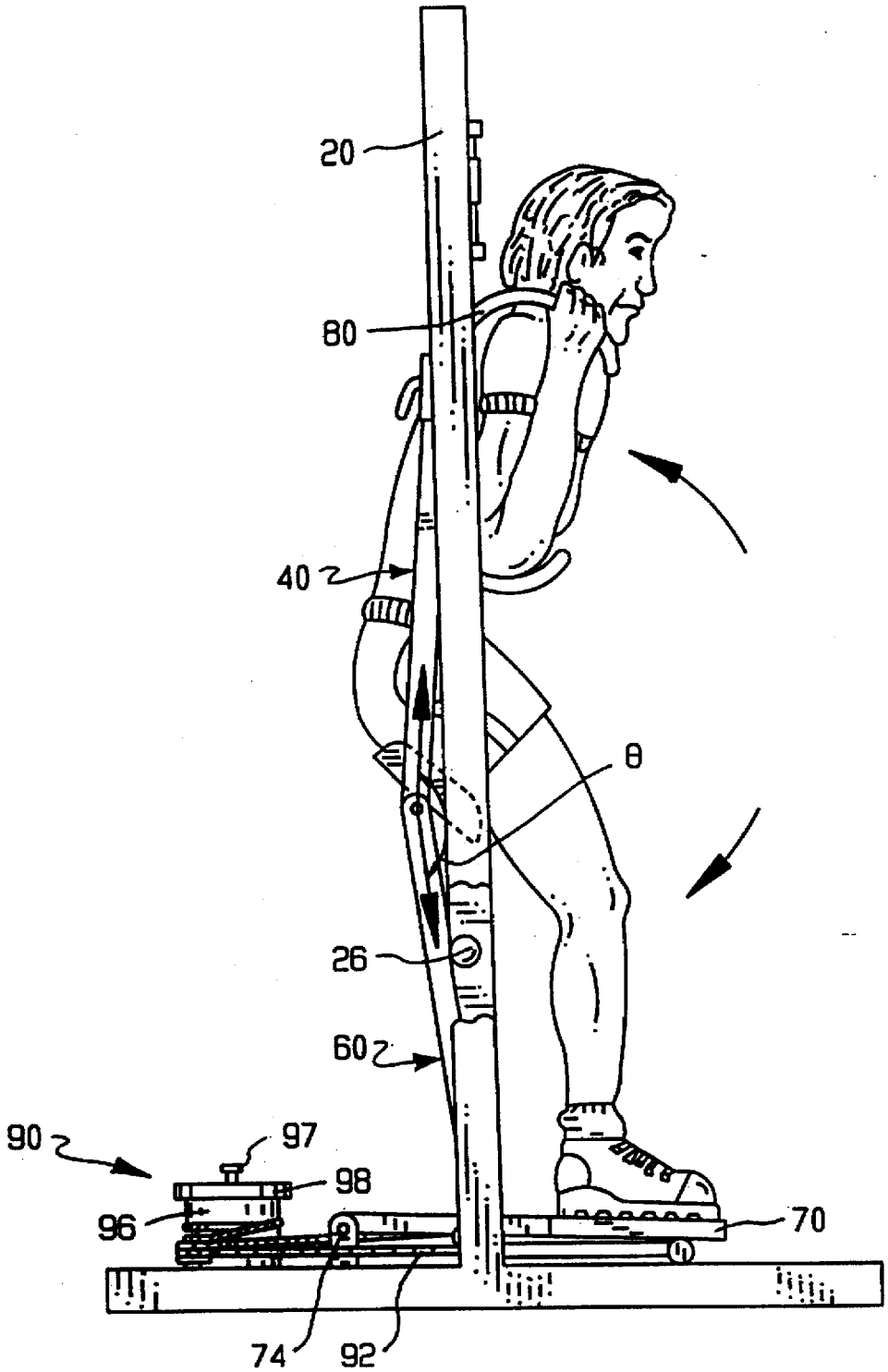
FIG. 6 is a side view of a user in a return straightening movement on the apparatus according to the present invention.

Exercise on this apparatus essentially comprises two movements, a forward folding movement as illustrated in FIG. 5 and a return straightening movement as illustrated in FIG. 6. The angle θ, which is defined by the upper frame 40 and the lower frame 60 as shown in FIG. 5, constantly changes during exercise, decreasing steadily during the forward folding movement and increasing steadily during the return straightening movement.

During the forward folding movement, the user exerts his abdominal muscles to pull the arm rests 80 toward the foot rest 70, thereby rocking or pivoting the upper frame 40 toward the lower frame 60. As the lower frame 60 pivots, the rollers 68 at the end of the projecting member 66 push against and roll along the foot rest 70, causing it to pivot about the foot pivots 74 as shown in FIGS. 5 and 6. The pivoting action of the foot rest 70 causes the knees to bend as θ decreases.

Then during the return straightening movement, the user exerts his back muscles to pull the arm rests 80 away from the foot rest 70, rocking or pivoting the upper frame 40 away from the lower frame 60. The apparatus stops as soon as the user stops exerting his muscles.

Stops 26 may be provided on the vertical frame 20 as shown in FIGS. 5 and 6 to control the range of movement of this apparatus. The stops 26 prevent θ from exceeding 180°, thereby reducing the chance of physical injury to the user by preventing him from extending his pelvic region beyond his feet in a vertical stance. Of course, the stops 26 may be designed such that the upper limit of θ is less than 180° in a manner known in the art. The cables 92 may also be used to control the range of θ or movement of this apparatus.

Figure 7:
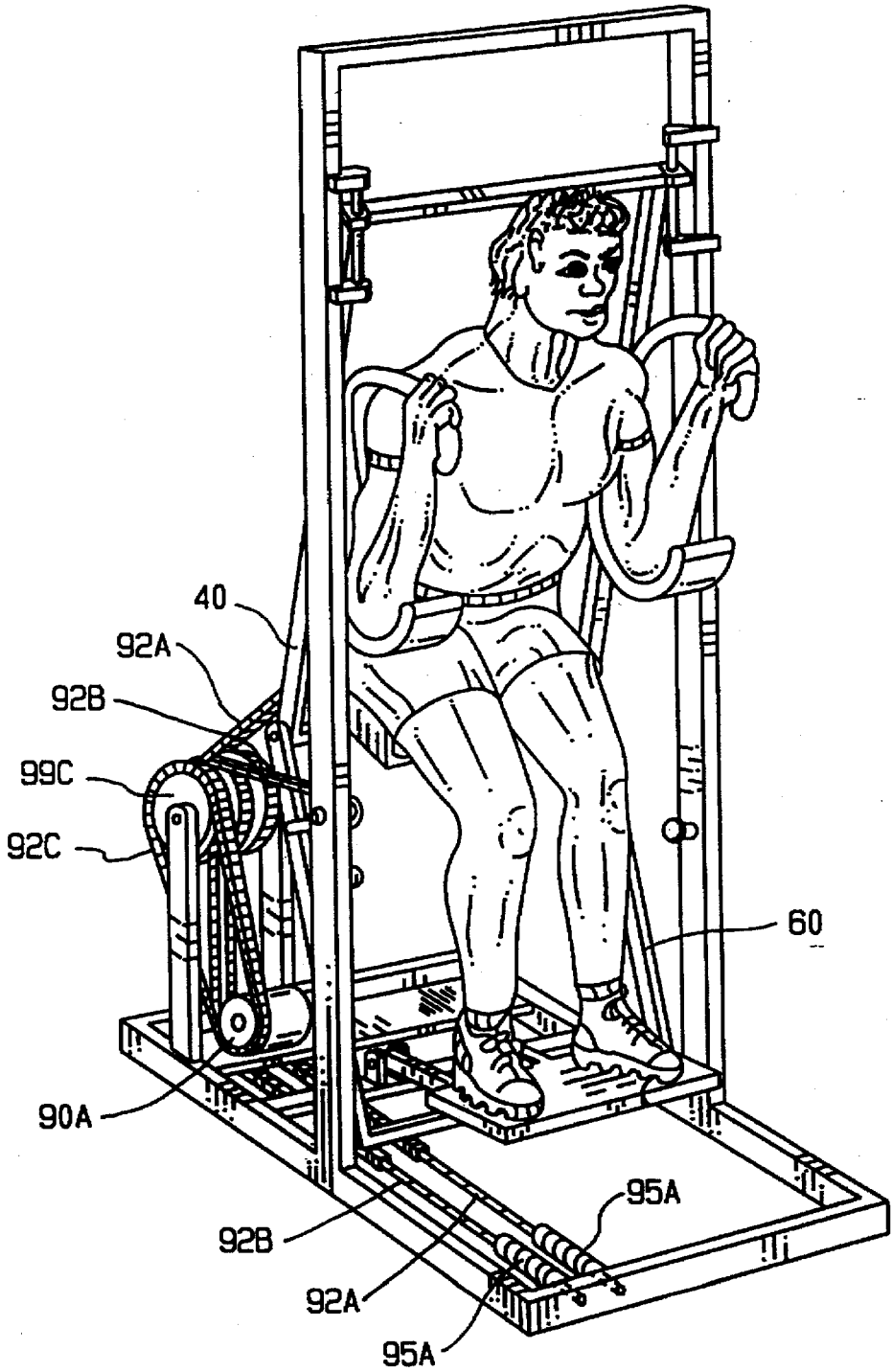
FIG. 7 is a first alternative embodiment of the present invention which includes an electro-magnetic resistance mechanism.
Figure 8:
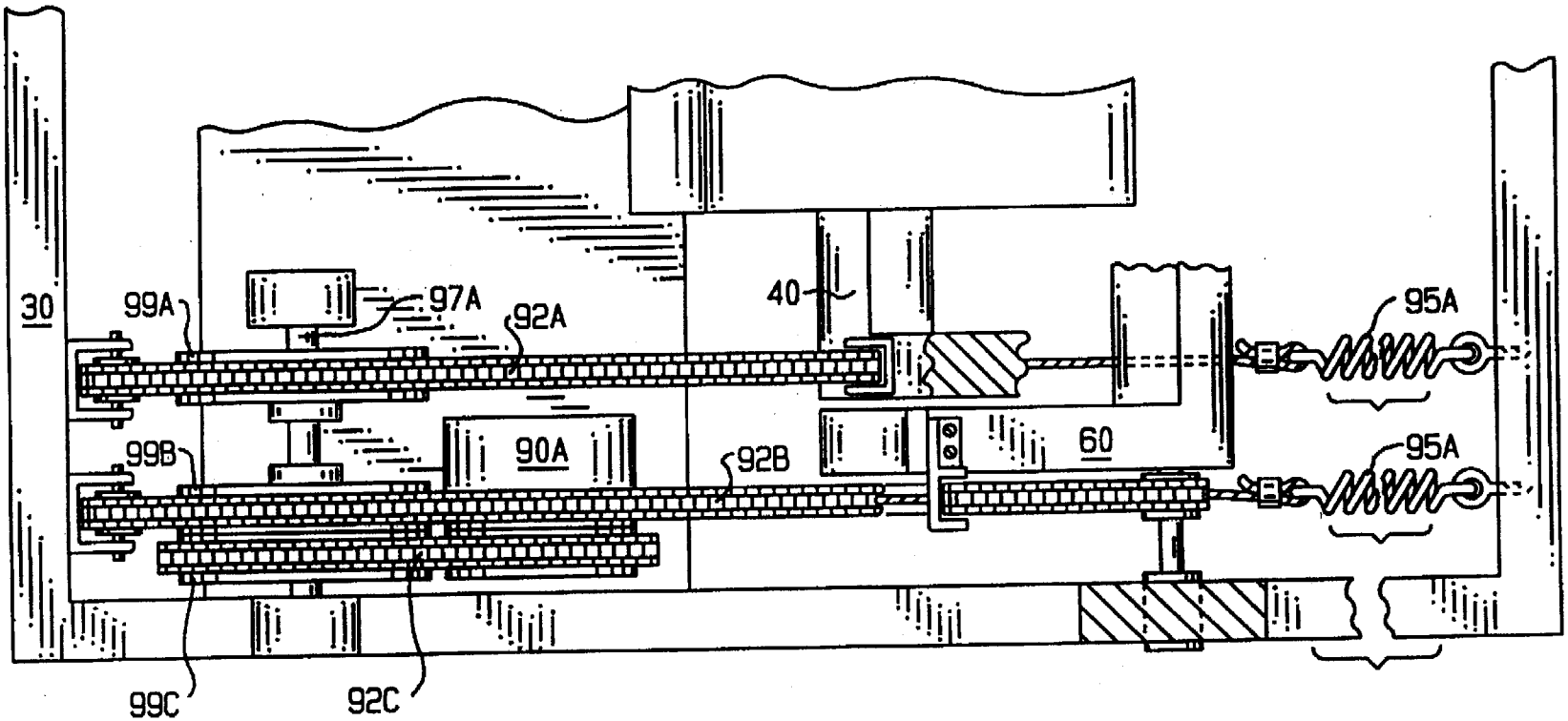
FIG. 8 is a top view of the chain and sprocket mechanism.

Persons of ordinary skill in the art will appreciate that resistance means other than the fly wheel-fan resistance mechanism described above may be readily adapted to the present invention. For example, as shown in FIG. 7 the apparatus may employ an electro-magnetic resistance mechanism 90A. As seen more fully in FIG. 8, chains 92A, 92B connected to the upper and lower frame 40, 60 respectively, traverse around sprockets 99A, 99B, which are mounted concentrically with sprocket 99C on shaft 97A. Shaft 97A is mounted to the horizontal frame 30. The chains 92A, 92B then continue in a parallel arrangement around a system of pulleys 94A (not shown) to connect with return springs 95A. Chain 92C is wound around the associated sprocket of the electromagnetic resistance mechanism 90A, the operation of which is understood by persons skilled in the art.

Figure 9:
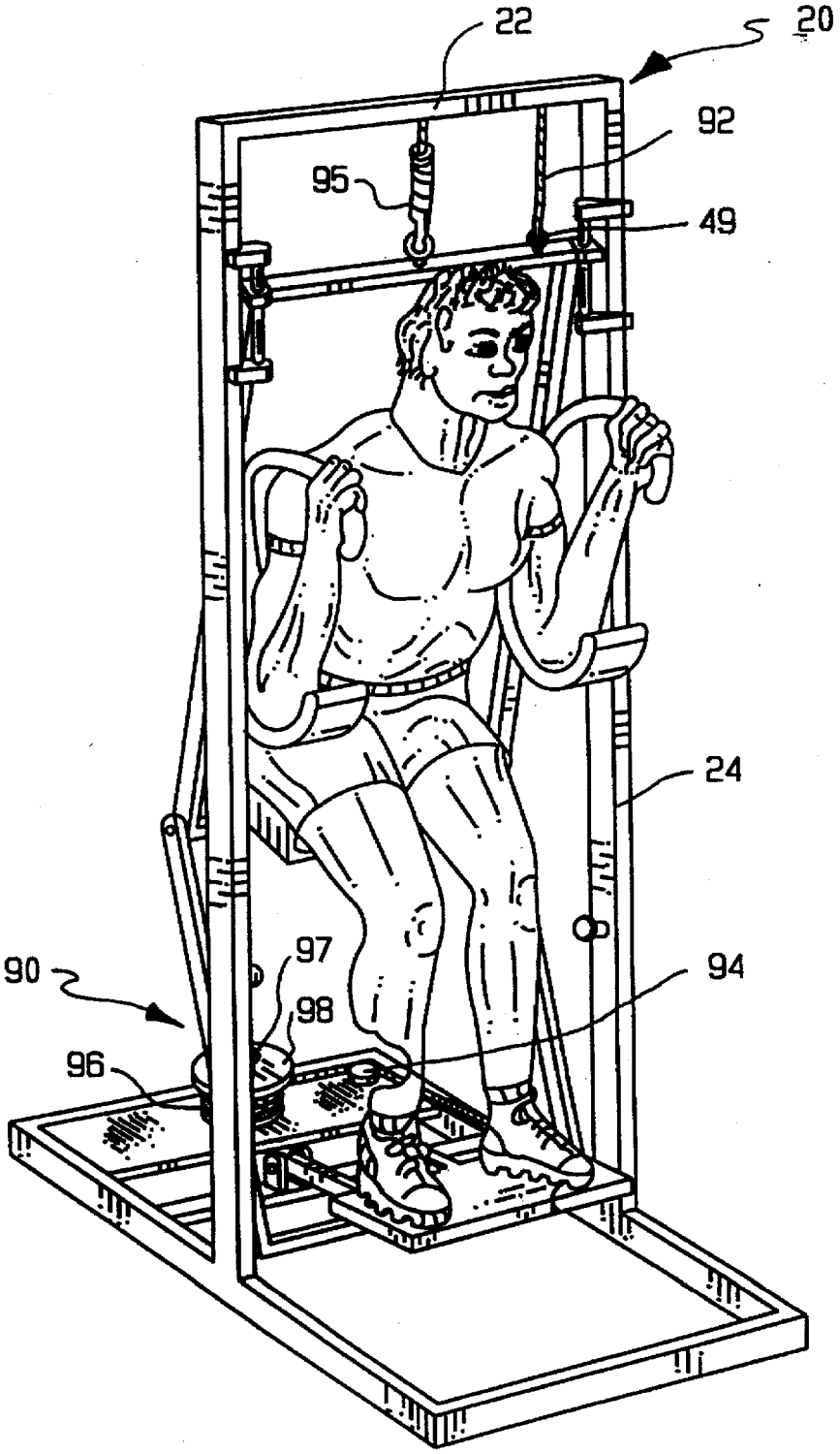
FIG. 9 is a second alternative embodiment of the present invention which provides resistance to only one of the two exercise movements with a fly wheel-fan resistance mechanism.

A further alternative embodiment of the present invention is illustrated in FIG. 9. In this embodiment, resistance is provided only against the forward folding movement, and not against the return straightening movement. In this embodiment, only one cable 92 runs from one cable connection 49, up to the top member 22 of the vertical frame 20, within the top member 22 of the vertical frame 20, then down within the lateral member 24 of the vertical frame 20 to the base of the vertical frame 20. The cable 92 is guided by pulleys 94 to the fly wheel-fan resistance mechanism 90 having a drum 96, a shaft 97 and a fly wheel-fan 98. The fly wheel-fan resistance mechanism 90 functions as previously set forth in connection with the description of the first embodiment. The drum 96 is further provided with torsion springs to rewrap the cable during the return straightening movement. An additional, optional spring, such as extension spring 95 can be provided for greater resistance and faster return.

Figure 10:
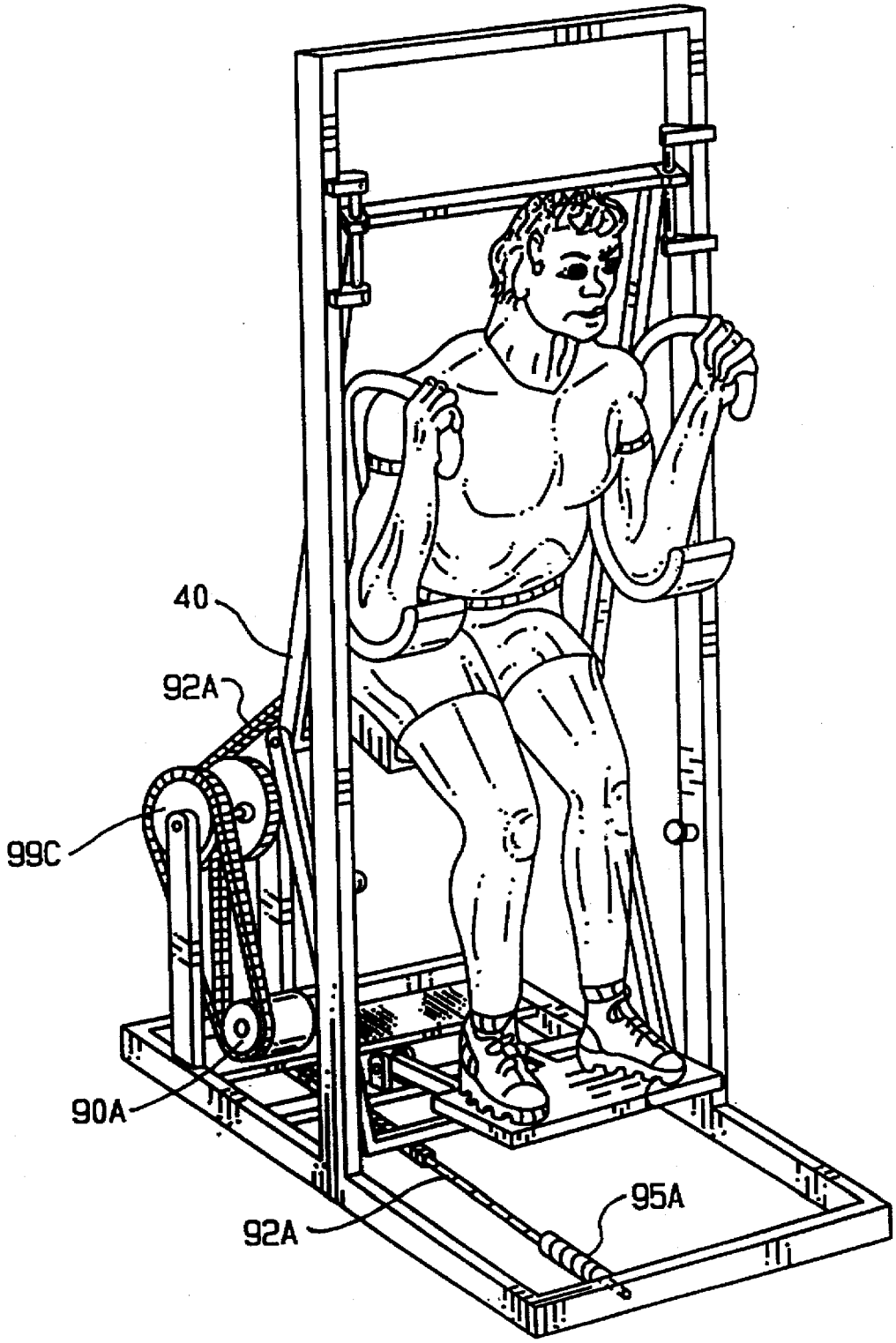
FIG. 10 is a third alternative embodiment of the present invention which provides resistance to only one of the two exercise movements with an electro-magnetic resistance mechanism.

A further alternative embodiment of the present invention is illustrated in FIG. 10. In this embodiment, resistance is provided only against the return straightening movement, and not against the forward folding movement. The resistance mechanism of this embodiment is the same as the resistance mechanism of the alternative embodiment illustrated in FIGS. 7 and 8 except that the former lacks the chain 92B and the sprocket 99B.

Figure 11:
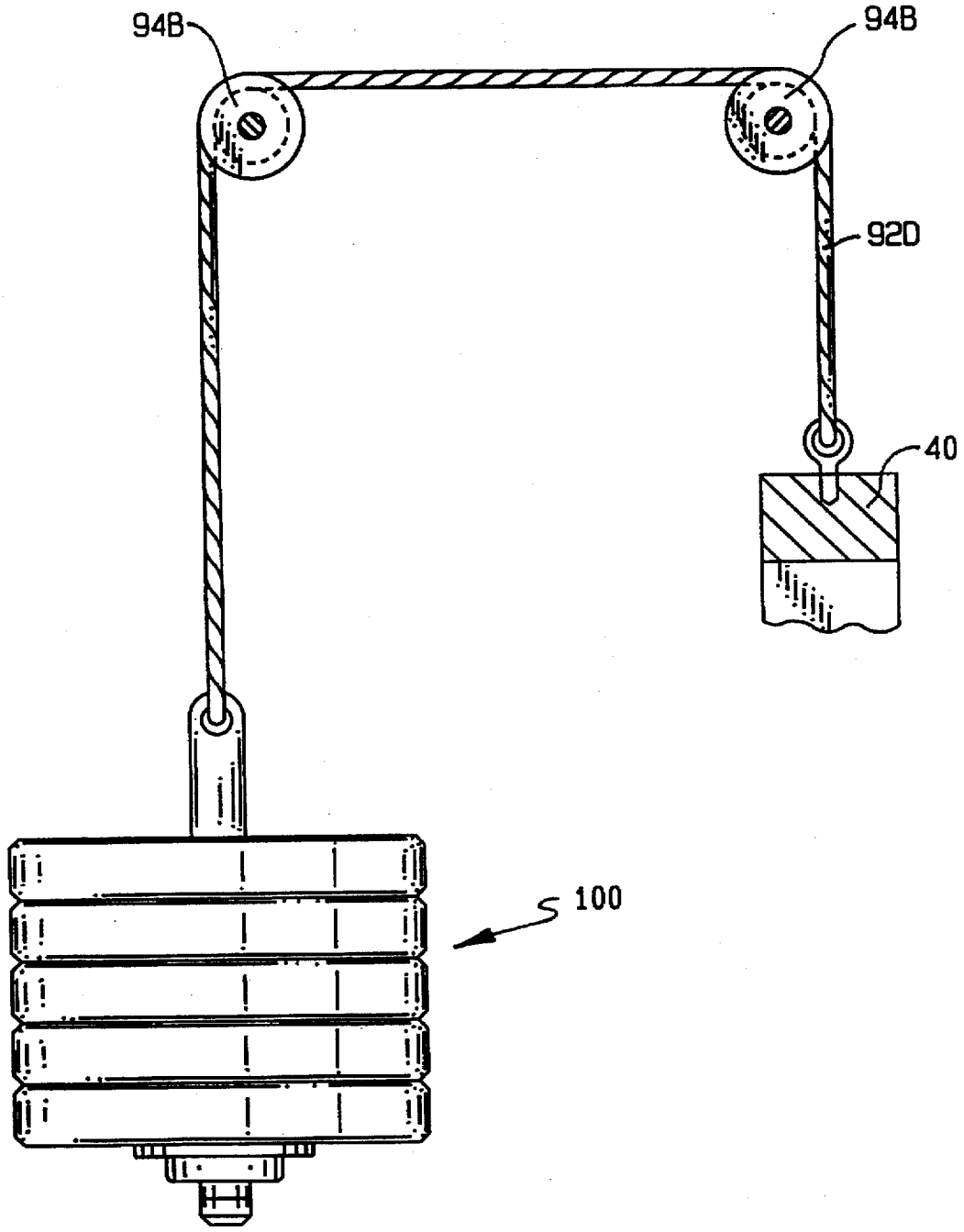
FIG. 11 is a partial view of a fourth alternative embodiment of the present invention which includes a weight stack resistance mechanism.

A weight stack also may be used for resistance in a manner known in the art. FIG. 11 schematically illustrates the apparatus in which resistance against the forward folding movement is provided by a weight stack. Cable 92D is secured to upper frame 40 and traverses around pulleys 94B to weight stack 100. The user may select the amount of weight desired. It is contemplated that a resistance mechanism which employs a weight stack also may be configured by a person of ordinary skill such that resistance may be provided against the return straightening movement.

Figure 12:
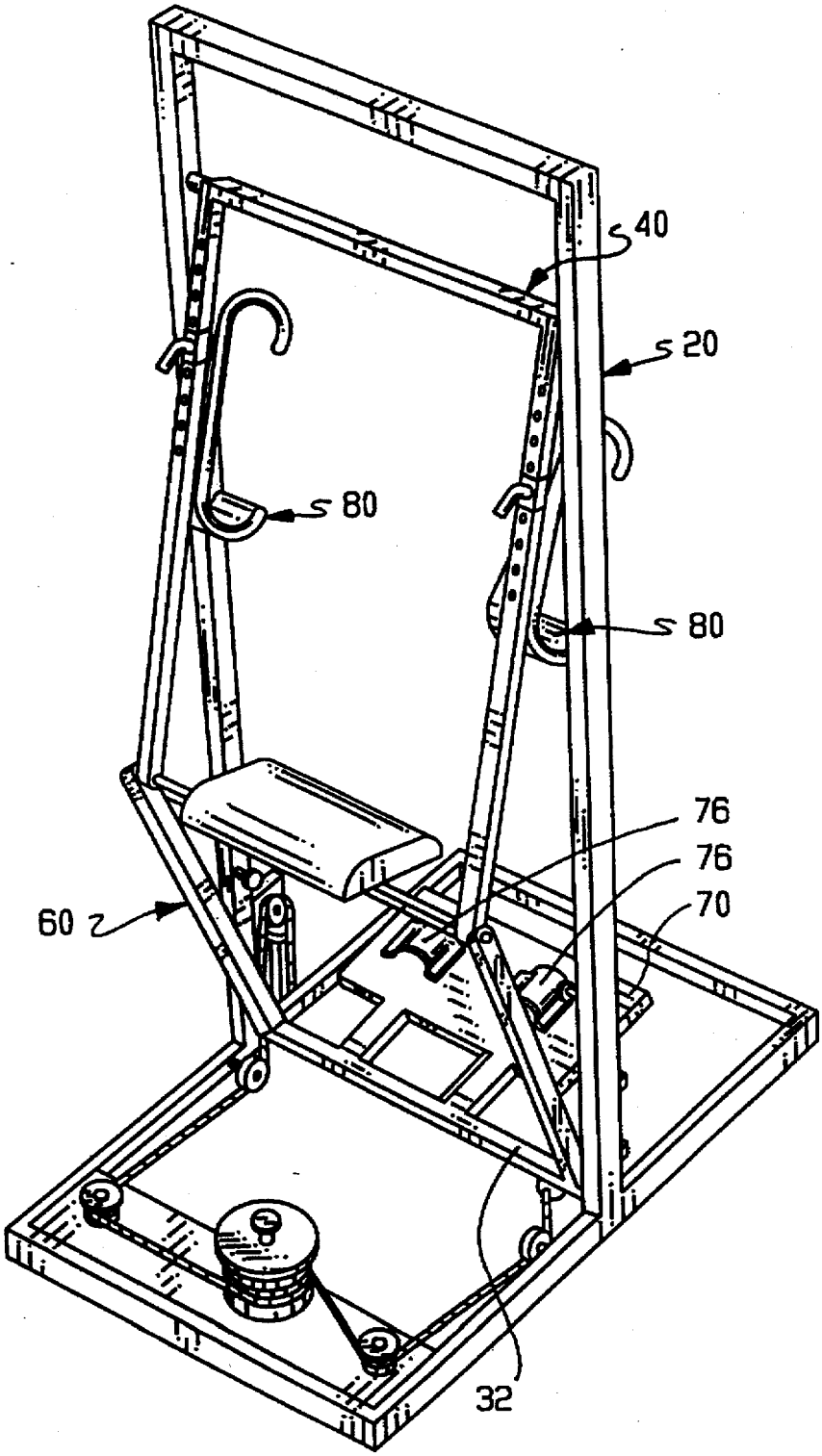
FIG. 12 is a fifth alternative embodiment of the present invention which permits the user to pull the foot rest up toward the arm rests.

A further alternative embodiment of the present invention is illustrated in FIG. 12. In this embodiment, the upper frame 40 and the lower frame 60 are pivotally mounted to the vertical frame 20 in a manner well known in the art. In this embodiment, the lower frame 60 is also slideably mounted to the vertical frame 20. Whereas, in the first embodiment of the present invention, the user pulls the arm rests 80 toward the foot rest 70 in order to effect the forward folding movement, in this embodiment, the user pulls the foot rest 70 toward the arm rests 80 to effect the forward folding movement. This embodiment increases the force required by the user's muscles and provides a more strenuous workout. In this embodiment, the foot rest 70 is additionally provided with foot stirrups 76. Any of the resistance means previously discussed may be easily adapted to this embodiment. In addition, the resistance means may be adapted to provide resistance against both the forward folding movement and the return straightening movement or either of the two.

It is also contemplated that each of the embodiments described above will include an adjustment means known in the art for providing varying degrees of resistance.

The present invention may be embodied in other forms without departing from its spirit or essential characteristics. The described embodiments are to be considered only as illustrative and not as restrictive. The scope of the invention is, therefore, indicated by the appended claims.

What is claimed:

1. An apparatus for exercising a user's abdominal muscles and back muscles, comprising:

framework means, wherein the framework means comprises a vertical frame mounted to a support means for stabilizing the apparatus;

dynamic means for producing a forward folding movement and a return straightening movement, requiring the use of a user's abdominal muscles during the forward folding movement and the use of a user's back muscles during the return straightening movement, wherein the dynamic means comprises an upper frame pivotally and slideably mounted to the vertical frame and a lower frame pivotally mounted to the vertical frame, said upper frame pivotally attached to said lower frame; and resistance means for opposing at least one of the forward folding movement and the return straightening movement.

2. The apparatus according to claim 1 wherein the resistance means comprises a fly wheel-fan mechanism and at least one cable connecting the dynamic means with the fly wheel-fan mechanism to resist movement of the dynamic means in at least one direction of movement.

3. The apparatus according to claim 2, further comprising a second cable connecting the dynamic means with the fly wheel-fan mechanism to provide resistance in both directions of movement.

4. The apparatus according to claim 1 wherein the upper frame and the lower frame are generally rectangular in shape.

5. The apparatus according to claim 1 wherein the dynamic means further comprises a seat which is attached to at least one of the upper frame and the lower frame of the dynamic means.

6. The apparatus according to claim 1 wherein the dynamic means further comprises two arm rests which are attached to the upper frame.

7. The apparatus according to claim 1 wherein the dynamic means further comprises a foot rest which is mounted to the lower frame.

8. The apparatus according to claim 1 wherein the dynamic means further comprises a foot rest and a bending means for bending a user's knees during use of the apparatus.

9. The apparatus according to claim 8 wherein the bending means comprises a plurality of rollers attached to a first end of a projecting member secured at a second end to the lower frame.

10. The apparatus according to claim 9 wherein the support means comprises a horizontal frame adapted to rest on a floor and wherein the foot rest, having a bottom surface, is pivotally attached to the horizontal frame and rests on the rollers of the bending means.

11. The apparatus according to claim 10 wherein the projecting member of the lower frame contacts the bottom surface of the foot rest as the lower frame pivots during use of the apparatus, causing the foot rest to pivot with respect to the horizontal frame which in turn applies a force acting on the user tending to cause the user's knees to bend during use of the apparatus.

12. An apparatus for exercising a user's abdominal muscles and back muscles, comprising:

a vertical support frame;

an upper frame pivotally and slideably attached at an upper end to the vertical support frame at a first attachment point;

a lower frame pivotally attached to the upper frame opposite the first attachment point such that the upper and lower frames pivot jointly in two directions, said lower frame also pivotally attached to the vertical frame;

a user interface means cooperating with the upper and lower frames to permit the user to manipulate said frames through a range of motion utilizing the user's abdominal and back muscles; and a resistance mechanism which resists the pivotal motion of the upper and lower frames in at least one direction.

13. The apparatus according to claim 12 wherein the user interface means comprises a seat which is attached to at least one of the upper frame and the lower frame.

14. The apparatus according to claim 12 wherein the user interface means comprises two arm rests which are attached to the upper frame.

15. The apparatus according to claim 12 wherein the user interface means comprises a foot rest which is mounted to the lower frame.

16. The apparatus according to claim 12 wherein the user interface means comprises a foot rest and a bending means for applying a force to the user tending to bend the user's knees during use of the apparatus.

17. The apparatus according to claim 16 wherein the bending means comprises a projecting member having two ends with one end secured to the lower frame and rollers mounted at the other end of the projecting member.

18. The apparatus according to claim 17 wherein the vertical support frame is mounted to a horizontal frame for stabilizing the apparatus and wherein the foot rest, having a bottom surface, is pivotally attached to the horizontal frame and rests on the rollers of the bending means.

19. The apparatus according to claim 18 wherein the projecting member contacts the bottom surface of the foot rest as the lower frame pivots during use of the apparatus, causing the foot rest to pivot with respect to the horizontal frame which in turn causes the user's knees to bend during use of the apparatus.

20. The apparatus according to claim 12 wherein the vertical support frame is mounted to a base for stabilizing the apparatus.

21. The apparatus according to claim 12 wherein the vertical support frame further comprises stop members to limit the range of motion of the upper and lower frames.

22. An apparatus for exercising a user's abdominal muscles or back muscles, comprising:

a vertical support frame;

an upper frame pivotally and slideably attached to the vertical support frame;

a lower frame pivotally attached to the upper frame such that the upper and lower frames pivot jointly along a first pivot axis in two directions, said lower frame also pivotally attached to the vertical support frame along a second pivot axis;

arm rests adjustably attached to the upper frame;

a seat pivotally attached to at least one of the upper frame and the lower frame along said first pivot axis;

a foot rest pivotally mounted adjacent the vertical support frame and adjacent the second pivot axis;

a projecting member extending from one side of the lower frame approximately perpendicular to the second pivot axis;

a plurality of rollers mounted on the projecting member opposite the lower frame, said rollers supporting the foot rest and causing the foot rest to pivot in response to pivoting of the upper and lower frames; and a resistance mechanism which resists the pivotal motion of the upper and lower frames in at least one direction.

23. A method for exercising abdominal and back muscles, comprising:

providing a substantially vertical frame structure for guiding a plurality of motions of a standing user;

guiding the user with said frame structure in a forward folding movement from a first position to a substantially V-shaped position, the user's body in the V-shaped position defining an apex and two outer points, by guiding the user's torso towards the user's feet in a first arcuate path having a center point approximately at the apex of the V-shape while rocking the hips backwards along a second arcuate path having a center point approximately at an outer point of the V-shape;

guiding the user with the frame structure in a return straightening movement by guiding the user's torso away from the user's feet to the first position along the first arcuate path while rocking the hips forward to the first position along the second arcuate path; and providing resistance against at least one of the forward folding movement and the return straightening movement by applying force to said frame structure.

24. The method according to claim 23 wherein the outer point of the V-shape is adjacent the user's feet.

25. The method according to claim 23 wherein the outer point of the V-shape is at the user's head.

26. An apparatus for exercising a user's abdominal muscles and back muscles, comprising:

framework means, wherein the framework means comprises a vertical frame mounted to a support means for stabilizing the apparatus;

dynamic means for producing a forward folding movement and a return straightening movement, requiring the use of a user's abdominal muscles during the forward folding movement and the use of a user's back muscles during the return straightening movement, wherein the dynamic means comprises an upper frame and a lower frame pivotally attached to each other, wherein the upper frame and the lower frame are pivotally mounted to the vertical frame and wherein one of the upper frame and the lower frame is also slideably mounted to the vertical frame; and resistance means for opposing at least one of the forward folding movement and the return straightening movement.

27. The apparatus according to claim 26 further comprising:

a horizontal frame to which the vertical frame is mounted;

arm rests adjustably attached to the upper frame;

a seat pivotally attached to at least one of the upper frame and the lower frame;

a foot rest attached to the lower frame;

two foot stirrups attached to the foot rest; and a resistance mechanism which resists the pivotal motion of the upper and lower frames in at least one direction.

28. The apparatus according to claim 26, wherein said lower frame is slideably attached to the vertical frame.

* * * * *